United States Patent [19]

Pesin et al.

[11] Patent Number: 5,020,859

[45] Date of Patent: Jun. 4, 1991

[54] APPARATUS FOR DISINTEGRATING MONOLYTHIC ENTITIES

[75] Inventors: Abram I. Pesin, Orel; Ivan V. Chevakin, Tula, both of U.S.S.R.

[73] Assignee: Spetsializirovanny Trest PO Remontu Promyshlennykh Zdany I Sorruzheny Predpriyaty Chernoi Metallurgii Tsentrainogo Raiona "Tsentremetallurgremont", Tula, U.S.S.R.

[21] Appl. No.: 477,891

[22] PCT Filed: Aug. 19, 1988

[86] PCT No.: PCT/SU88/00160

§ 371 Date: Apr. 25, 1990

§ 102(e) Date: Apr. 25, 1990

[87] PCT Pub. No.: WO90/02245

PCT Pub. Date: Mar. 8, 1990

[51] Int. Cl.[5] ..... E21C 37/04; E21C 37/06

[52] U.S. Cl. ..... 299/21; 299/23

[58] Field of Search ..... 299/20, 21, 23; 29/113.1; 166/187

[56] References Cited

U.S. PATENT DOCUMENTS

| | | | |
|---|---|---|---|
| 3,791,698 | 2/1974 | Darda | 299/23 |
| 4,871,212 | 10/1989 | Lebedev | 299/21 |

FOREIGN PATENT DOCUMENTS

| | | |
|---|---|---|
| 1028842 | 7/1983 | U.S.S.R. . |
| 1033819 | 8/1983 | U.S.S.R. . |
| 1180501 | 9/1985 | U.S.S.R. . |

*Primary Examiner*—Bruce M. Kisliuk
*Assistant Examiner*—David J. Bagnell
*Attorney, Agent, or Firm*—Burgess, Ryan & Wayne

[57] ABSTRACT

An apparatus for disintegrating monolythic entities including a body defined by two thrust plates capable of movement in a direction perpendicular to the longitudinal axis of the body. The body accommodates two parts similar in shape which contact the inner surface of the thrust plates and divide the interior of the body into four spaces, each accommodating an expansion chamber and two wedge-shaped inserts. Positioned between the parts dividing the interior of the body are additional wedge-shaped inserts movable on the surfaces of the similar parts, wherein positioned between the additional wedge-shaped inserts is an additional expansion chamber in contact with the additional wedge-shaped inserts.

10 Claims, 5 Drawing Sheets

APPARATUS FOR DISINTEGRATING MONOLYTHIC ENTITIES

TECHNICAL FIELD

The present invention relates to mining art and civil engineering and has specific reference to apparatus for disintegrating monolythic entities.

PRIOR ART

Known in the art is an appartus for disintegrating monolythic entities (SU, A, 1,033,819) incorporating a cylindrical body formed by two thrust plates fitted with provision for reciprocating back and forth at right angles to an axis of the body so as to exert a direct thrusting action on the entity subjected to disintegration, provided the apparatus is installed in a hole drilled in the monolyth. An expansion chamber made of a resilient material and containing a stiff rectilinear member in the form of a perforated tubular core extends axially inside the body in a coaxial position therewith. Pipe unions provided at the ends of the core serve to connect the expansion chamber to a source of high-pressure fluid. The ends of the expansion chamber are connected in an air-tight fashion to rigid flanges in the form of tapped sleeves screwing whereinto are the respective externally threaded pipe unions. An inside surface of each thrust plate is formed by two planes extending parallel to the longitudinal axis of the chamber and making an obtuse angle with each other. A portion of the inside surface of each thrust plate is contiguous to a portion of an outside surface of the expansion chamber. Two wedge-shaped inserts located at diametrically opposite sides relatively to the geometrical axis of the expansion chamber serve to set up orientated forces inside the body, i.e., between the thrust plates. A plane surface of each wedge-shaped insert contacts the outside surface of the expansion chamber with a portion thereof not in contact with the respective thrust plate, and two side surfaces of each wedge-shaped insert, forming an acute angle with each other, are contiguous to plane surfaces of the inside surface of the respective thrust plate. The wedge-shaped inserts are designed to transmit the force exerted by the expansion chamber to the thrust plates within those portions of the expansion chamber which do not contact the thrust plates. The wedge-shaped inserts also serve as sealing means of the expansion chamber within the areas in contact with them. The thrust plates are held fast to the expansion chamber by a fastener in the form of a board ring in a resilient material which girdles the body from the outside, fitting into an annular groove of the body.

The known apparatus has failed to receive widespread application due to a comparatively low pressure, commonly not over 100 MPa, which the expansion chamber is capable of creating. The force of the apparatus exerts on the walls of the hole drilled in the monolyth is consequently low. The point is that the high axial loads imposed by the compressed fluid on the end faces of the stiff rectilinear member and the end faces of the flanges held fast to this member cause it to elongate so that gaps are formed between the end faces of the flanges and those of the thrust plates which face each other. Packing these gaps under pressure over 100 MPa is a problem so that the resilient material of the expansion chamber bulges thereinto. The remedy in this case, brought about by an excessive elongation of the rectilinear tubular member, is to increase the stiffness of this member.

This can be accomplished by increasing the diameter of the tubular member. However, an increase beyond a certain limit, decided by the size of the space inside the expansion chamber which, in turn, is dictated by the thickness of the walls of this chamber and the over-all dimensions of the apparatus in cross section is impossible. Any increase in the size of the space in the expansion chamber without changing the thickness of the walls thereof and the over-all cross-sectional dimensions of the apparatus reduces the length of travel (stroke) of both the wedge-shaped inserts and thrust plates. The cross-sectional area of the tubular member is also reduced by the bore thereof and the perforations in the side wall thereof which serve to admit fluid into the expansion chamber.

Also known is an apparatus for disintegrating monolythic entities (PCT/SU 87/00008) incorporating a cylindrical body an inside surface whereof is a polygon in cross section. The body is formed by at least two thrust plates fitted with provision for reciprocating back and forth at right angles to a longitudinal axis of the body so as to exert a direct thrusting action on the entity subjected to disintegration when the apparatus is installed in a hole drilled in the monolyth. A partitioning means which is a rhombus in cross section is provided inside the body, extending along the longitudinal axis thereof in a coaxial position therewith. The partitioning means divides the space inside the body into two parts each accommodating an expansion chamber, in a resilient material communicating with a source of fluid, and wedge-shaped inserts positioned on either side of each expansion chamber in contact therewith. Each of the wedge-shaped inserts is trapeziform in cross section so that those plane surfaces of each wedge-shaped insert which are not out of contact with the respective expansion chamber are in contact with the inside surface of the thrust plate and that of the partitioning means. When fluid is admitted into the expansion chambers, these get swollen and come into contact with the thrust plates and partitioning means, exerting pressure thereupon and upon the wedge-shaped inserts as well.

The wedge-shaped inserts also transmits the forces set up by the expansion chambers to those areas of the thrust plates which are out of contact with the expansion chambers, and the partitioning means checks the swelling of the expansion chambers towards the longitudinal axis of the body. As a result, this swelling is orientated towards the thrust plates and wedge-shaped inserts which exert pressure on the monlyth subjected to disintegration. In other words, the partitioning means performs a backing-up function. It consists of a rod with a rhombic cross section and flanges held fast to the end faces thereof. Pipe unions screwing into the flanges serve to admit compressed fluid into the expansion chambers which have their ends attached to the unions an air-tight fashion. The thrust plates are pressed against the expansion chambers and each other by a fastener consisting of four external rings in a resilient material spaced equidistantly apart all the way down the length of the thrust plates. The apparatus for disintegrating monolythic entities of the above design dispenses with the rectilinear tubular member whose backing-up function is taken care of by the partitioning means positioned between the resilient expansion chambers. This feature of the design enhances the stiffness of the structures and provides for utilizing all the space in the body not occupied by the resilient expansion chambers, the spreading out thrust plates and the wedge-shaped inserts. The transverse dimensions of the resilient expansion chambers do not influence the cross-sectional area of the body.

The prior art apparatus for disintegating monolythic entities is a useful tool for breaking large stone blocks at quarries. It not only triggers a crack between the holes but caters for the crack propagate into the depth of the monolyth over the entire plane of separation. The larger the stroke of the thrust plates, the greater the surface area of separation for a given footage of the holes working wherefrom is the apparatus.

However, the prior art apparatus cannot cope with reinforced concrete structures. The breaking stresses set up by the partitioning means and the tensile forces created by the thrust plates occur at the same stage and are too low for the reinforcements to be tensioned to the point of breakage.

SUMMARY OF THE INVENTION

The principal object of the invention is to provide an apparatus for disintegrating monolythic entities wherein a partitioning means and other additional components are designed and arranged relative to each other in such ways which would promote the setting up of an additional disintegrating force acting on the entity stepwise with a mounting magnitude.

This object is realized by disclosing an apparatus for disintegrating monolythic entities incorporating a body, which is formed by at least two thrust plates—with fastening means—fitted with provision for reciprocating back and forth at right angles to a longitudinal axis of the body, and a partitioning means creating spaces in the body accommodated in each whereof there are an expansion chamber communicating with a source of fluid and wedge-shaped inserts contacting the expansion chamber, the partitioning means and an inside surface of the respective thrust plate, wherein, according to the invention, the partitioning means is provided in the form of identical components by the number of the thrust plates which are arranged symmetrically relatively to the longitudinal axis of the body and have their surfaces facing this axis formed by two intersecting planes extending parallel to this axis, additional wedge-shaped inserts are introduced between the components with provision for displacing along the surfaces thereof facing the longitudinal axis of the body and an additional expansion chamber contacting the additional wedge-shaped inserts is interposed therebetween in a coaxial position with the longitudinal axis of the body.

It is expedient that in the apparatus, according to the invention, the sides of the additional wedge-shaped inserts which face the outside are provided with reinforcing elements.

It is also expedient that in the apparatus, according to the invention, those surfaces of the additional wedge-shaped inserts which face the longitudinal axis of the body match each other and have recesses forming a space confined whereto is the additional expansion chamber and that sealing means are provided between the additional expansion chamber and the additional wedge-shaped inserts within the matching surfaces thereof.

It is further expedient that in the apparatus, according to the invention, the sealing means are provided in the form of gaskets with segmental cross sections.

It is preferred that in the apparatus, according to the invention, each additional wedge-shaped insert is trapeziform in cross section and consists of three parts matching each other along a line parallel to the large base of the trapezoid, whereby an other additional expansion chamber is provided between the two parts of each additional wedge-shaped insert which form the small base of the trapezoid so as to contact these parts.

It is also preferred that in the apparatus, according to the invention, the parts of each additional wedge-shaped insert which form in cross section the small base of the trapezoid are fitted so as to match each other along a line extending at right angles to the large base of the trapezoid and that recesses are provided in the matching surfaces of these parts which form a space contained wherein is a further additional expansion chamber.

It is further preferred that in the apparatus, according to the invention, each additional wedge-shaped insert is provided with sealing means fitted between the further additional expansion chamber and the parts of each additional wedge-shaped insert which form in cross section the small base of the trapezoid, within the matching surfaces of the parts.

It is practical that in the apparatus, according to the invention, the sealing means of the additional wedge-shaped inserts are gaskets with segmental or triangular cross sections.

The apparatus for disintegrating monolythic entities of the design disclosed hereinabove exerts an extra disintegrating force in a number of stages the effect whereof mounts as the stroke of the thrust plates increases. This is attributed to the fact that the partitioning means consists of two identical components located wherebetween is the additional expansion chamber enclosed at diametrically opposite sides by the additional wedge-shaped inserts fitted with provision for reciprocating back and forth along those surfaces of the identical components of the partitioning means which face the longitudinal axis of the body.

The additional wedge-shaped inserts acted upon by the additional expansion chamber, on being introduced into a hole, give rise to both concentrated stresses all the way along their length and to tension stresses in the plane of the crack when the thrust plates directly acted upon by the additional wedge-shaped inserts exert pressure on the wall of the hole.

The reinforcing elements add to the strength of the outside surface of the additional wedge-shaped inserts.

The recesses in the surfaces of the additional wedge-shaped inserts which form the space confined whereto in the additional expansion chamber put the entire surface of this chamber to a useful purpose. They also seal off the space around the additional resilient expanson chamber and set up a uniform load all the way along the perimeter thereof.

The sealing means provided at the matching portions of the additional wedge-shaped inserts seal off the clearances existing therebetween. This prevents the material of the additional expansion chamber from sagging so that the pressure of the fluid can be significantly increased and so can be, in consequence, the force exerted by the thrusting plates of the apparatus.

The sealing means in the form of gaskets with a segmental cross section add to the operational reliability of the apparatus when compressed fluid is being fed thereinto. They also provide for shaping the resilient additional expansion chamber so that the load it creates is unifirmly distributed all the way along the perimeter thereof.

The other additional expansion chambers confined to the spaces in the additional wedge-shaped inserts are a source of extra force which the thrust plates can exert when acted upon the parts of each additional wedge-shaped insert moved apart by the other additional expansion chambers. The extra force is needed to break the reinforcements when these are of a heavy-gauge section or dense in the concrete.

The sealing means provided within the matching surfaces of the parts of each additional wedge-shaped insert seal off the clearance and prevent the resilient material of the other additional expansion chamber from sagging.

The sealing means in the form of gaskets with a segmental cross section provide for shaping the other additional expansion chamber when fluid is being fed thereinto, so that the load this chamber creates is uniformly distributed all the way along the perimeter thereof.

The sealing means in the form of gaskets with a triangular cross section not only seal off the clearances and prevent the resilient material of the other additional expansion chambers from sagging, they also extend the stroke of the moving-apart parts of the wedge-shaped insert and augment, in this way, the force developed by the thrust plates of the apparatus.

The disclosed apparatus for disintegrating monolythic entities has gained wide-spread recognition and is convenient in operation.

BRIEF DESCRIPTION OF THE DRAWINGS

These and other advantages of the present invention will be best understood from the following description of a preferred embodiment thereof given by way of example with reference to the accompanying drawings, wherein.

PREFERRED EMBODIMENT OF THE INVENTION

Figure 1:
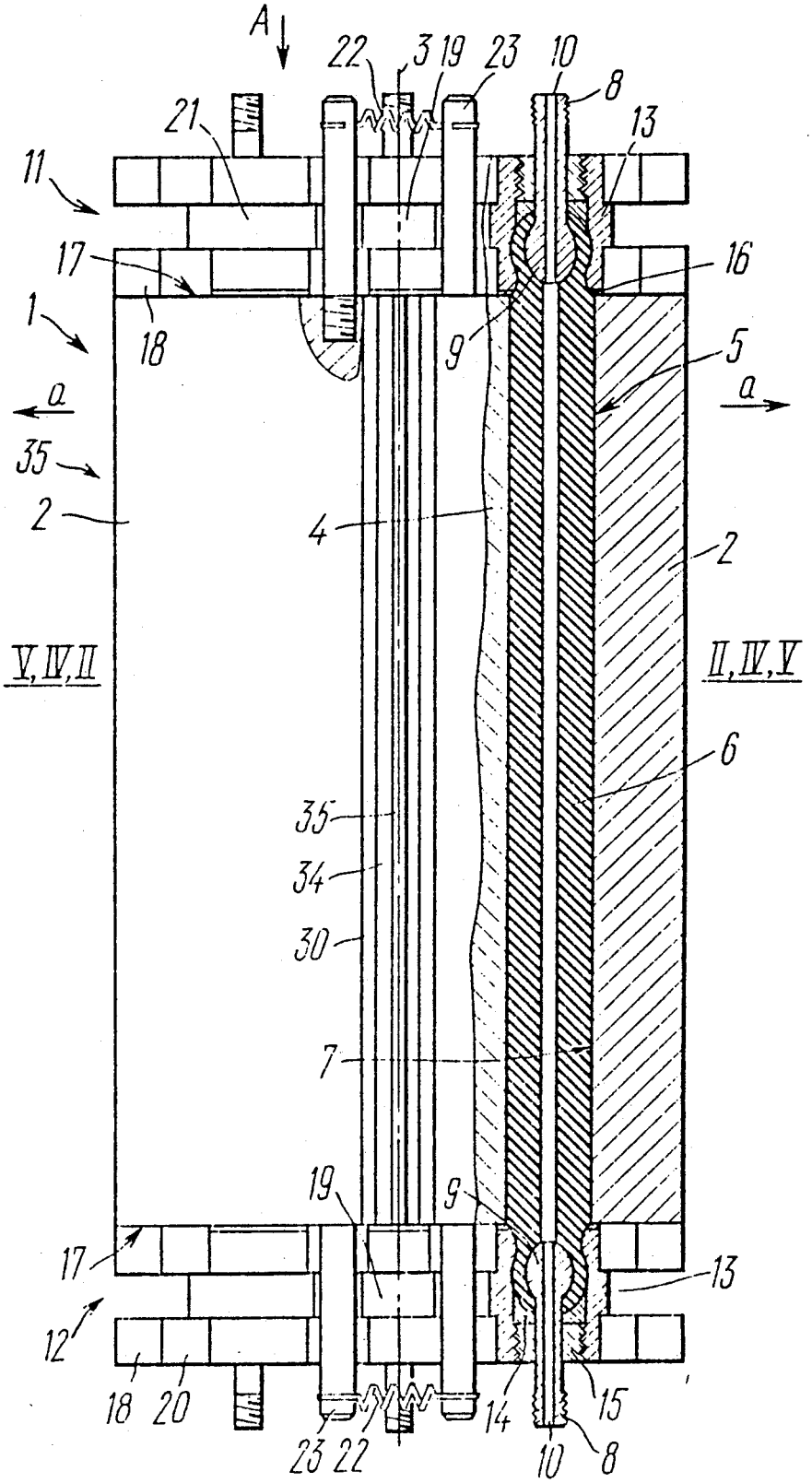
FIG. 1 is a schematic general view, shown in elevation partly cut away, of the apparatus for disintegrating monolythic entities, according to the invention.

The apparatus for disintegrating monolythic entities which is realized in accordance with the present invention and is designed, e.g., for applying thrusting forces in demolishing old reinforced concrete structures and breaking rock is referred hereinafter as "disclosed apparatus" for the sake of brevity.

The disclosed apparatus consists of a cylindrical body 1 (FIG. 1) formed by thrust plates 2 in the case under consideration which are arranged longitudinally with provision for reciprocating back and forth at right angles to a longitudinal axis 3 of the body 1, as shown by arrow a.

A partitioning means 4 is provided in the body 1 in a coaxial position with the longitudinal axis 3 thereof, which is a rhombus in cross section (not shown) and forms spaces 5 in the body 1. Expansion chambers 6 made of a resilient material are contained in the spaces 5, their walls 6 contacting an inside surface 7 of the body 1 and partitioning means 4.

The ends of the expansion chambers 6 are fitted on pipe unions 8, namely on heads 9 thereof shaped each as two truncated cones joined at their large bases. Valves (not shown) are provided in the pipe unions 8 which shut off passages 10 when the expansion chambers 6 are filled with fluid. The valves can be of any known design suitable for this purpose.

The ends of the chambers 6 fitted on the pipe unions 8 are held fast in two flanges 11, 12 with the aid of sleeves 13, rings 14 and nuts 15. Each sleeve 13 is fitted on the pipe union 8, each ring is fitted into the sleeve 14 so tha that its taper surface is in contact with the end of the chamber 6. When the nut 15 is taken up in the sleeve 13, the taper surface of the ring 14 is tightly pressed to the end of the expansion chamber 6 which, in its turn, tightly fits the taper surface of the head 9 of the pipe union 8. A resilient gasket 16, i.e. a kapron one, is provided between an end of the sleeve 13 and an end face 17 of the partitioning means 4 to seal off the clearance and safeguard the chamber 6 against damage by sharp edges.

The flanges 11, 12 fitted at the end faces 17 of the partitioning means 4 consist each of two guide plates 18 with a distance piece 19 interposed therebetween. The sleeves 13 fit into grooves 20 of the guide plates 18, and collars 21 of the sleeves 13 are each of a height smaller than that of the distance piece 19. This provides room for the chambers 6 to expand. The thrust plates 2 are fixed relatively to each other by fastening means in the form of springs 22 fitted to pins 23.

Figure 2:
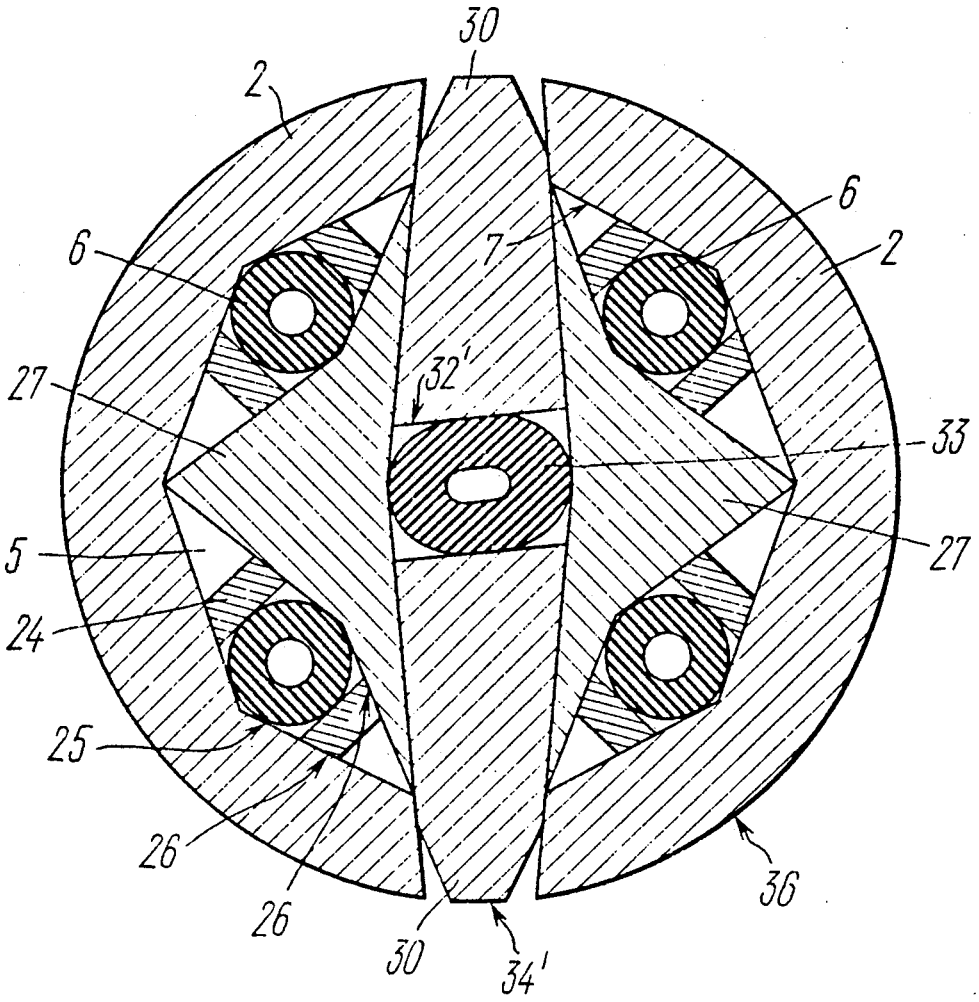
FIG. 2 is a section on line II—ii of FIG. 1.
Figure 3:
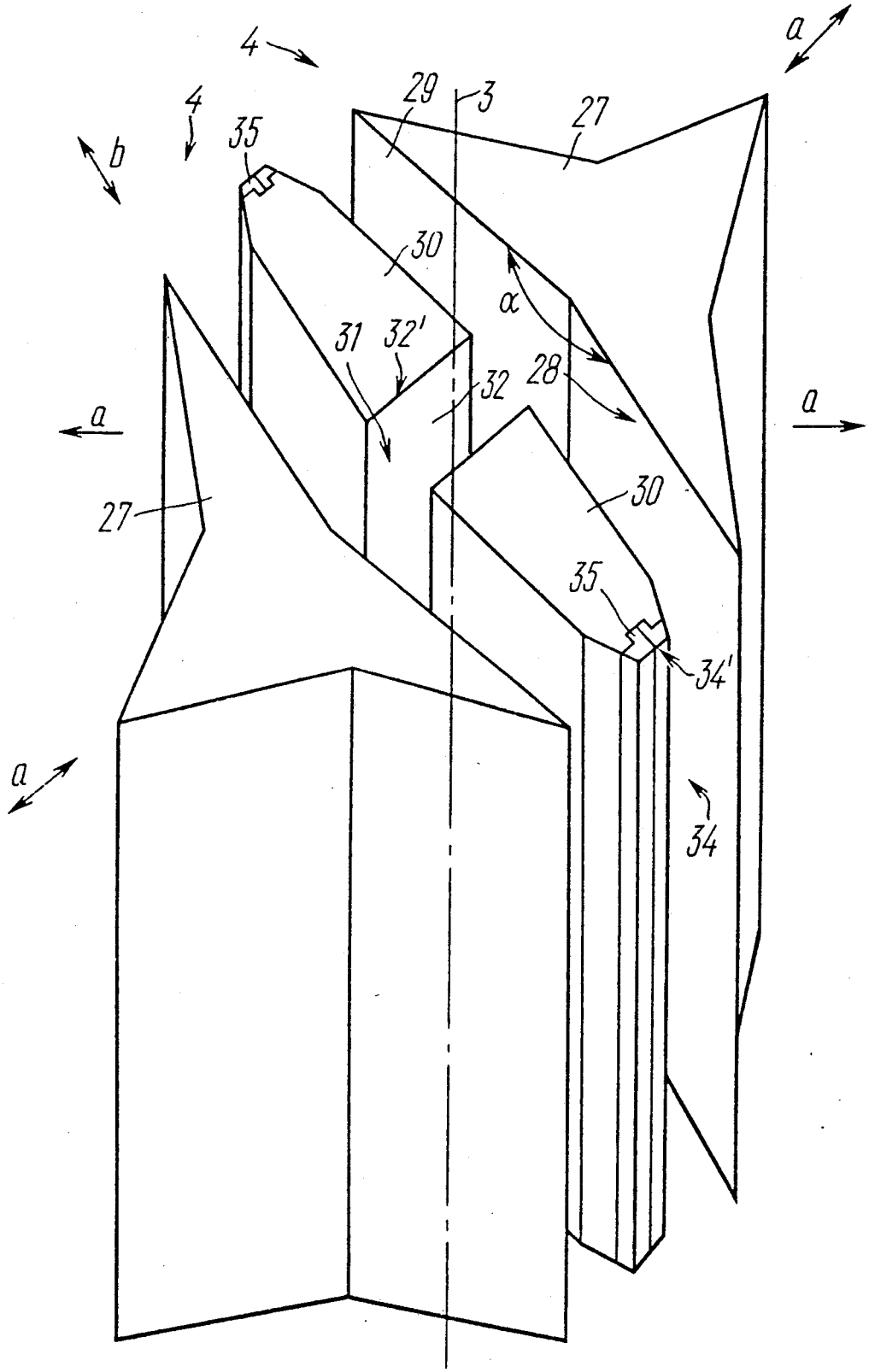
FIG. 3 is a schematic view of an assembly of the apparatus for disintegrating monolythic entities, according to the invention, which comprises the thrust plates arranged to move apart and the partitioning means in the form of two identical components.

FIG. 2 distinctly indicates the way the expansion chambers 6 are located in the body 1. The inside surface 7 of the body 1 formed by two thrust plates 2 is a polygon in cross section. Each of the expansion chambers 6 is contained in the space 5 of its own which is bound by the partitioning means 4 and the inside surface 7 of the body 1. A pair of wedge-shaped inserts 24 is contained in each of the spaces 5. Being of the trapeziform cross section, each pair of the wedge-shaped inserts 24 is arranged so that the large bases 25 of the trapezoids they form in cross sections face one another and the sides 26 of the trapezoids contact the partitioning means 4 and the inside surface 7 of the body 1. Each of the expansion chambers 6 is in fact interposed between the respective pair of the wedge-shaped inserts 24 and contacts both the thrust plate 2 and the partitioning means 4 comprising two identical components 27 positioned symmetrically with respect to the longitudinal axis 3 (FIG. 3) of the body 1 (FIG. 1). The components 27 (FIG. 3) are fitted with provision for reciprocating back and forth, as shown by arrow a, at right angles to the longitudinal axis 3 of the body 1. A surface 28 of each component 27 facing the longitudinal axis 3 is formed by two planes 29 which make an angle $\alpha$ with one another and extend parallel to the axis 3. The angle $\alpha$ is greater than 90° on the case under consideration. Two additional wedge-shaped inserts 30 (FIG. 2) of trapeziform cross section are interposed between the components 27 with provision for reciprocating back and forth over the surfaces 28 as shown by arrow b (FIG. 3). An additional expansion chamber 33 (FIG. 2) is provided in a space 31 (FIG. 3) bound by the components 27 of the partitioning means 4 and surfaces 32 of the additional wedge-shaped inserts 30 which face the longitudinal axis 3 and form each the large base 32' of a respective trapezoid in cross section. The additional expansion chamber 33 contacts the additional wedge-shaped inserts 30 and the components 27 of the partitioning means 4.

Surface 34 of the additional wedge-shaped inserts 30, which face the outside and are seen in FIG. 1 between the thrust plates 2, form each the small base 34' (FIGS. 2, 3) of the respective trapezoid in cross section.

Figure 4:
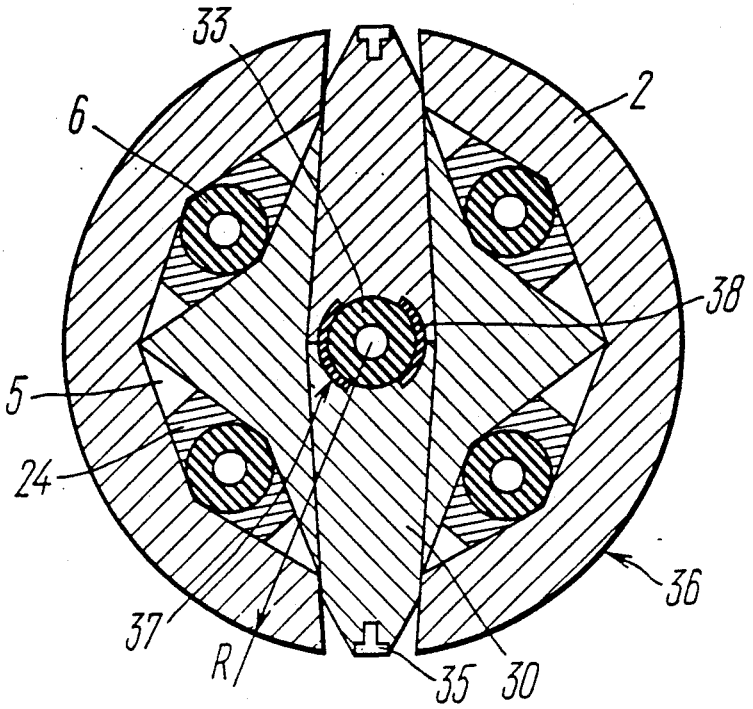
FIG. 4 is a section on line IV—IV of FIG. 1.

Reinforcing elements 35 in the form of bars in a hard alloy, e.g., one known under the trade name Pobedit, can be fitted to the side 34 of the additional wedge-shaped inserts 30 (FIGS. 1, 3, 4) so that the outside surface of each reinforcing element 35 which is the farthest from the longitudinal axis 3 of the body 1 is located from this axis at a distance R (FIG. 4) which is the radius of the outside surface 36 of the body 1. The reinforcing elements 35 extend down the full length of the additional wedge-shaped inserts 30.

It will be noted from FIG. 3 that the additional wedge-shaped inserts 30 are arranged so that their surfaces 32, facing the longitudinal axis 3 of the body 1 and forming the large bases 32' of the trapezoids, match each other. Recesses 37 (FIG. 4) setting up a bound for the space 31 (FIG. 3) confined whereto is the additional expansion chamber 33 (FIG. 4) are provided in the surfaces 32.

The apparatus is provided the sealing means in the form of gaskets 38 which are made, e.g., of rubber and have segmental cross sections. The gaskets 38 are located between the additional expansion chamber 33 and the additional wedge-shaped inserts 30 within the matching side surfaces 32 (FIG. 3). The gaskets 38 fit into the recesses 37 which are shaped in cross section so as to fit both the additional expansion chamber 33 and the sealing elements, i.e., the gaskets 38 rather than to be an arc of a circle in a strict meaning of these words.

Figure 5:
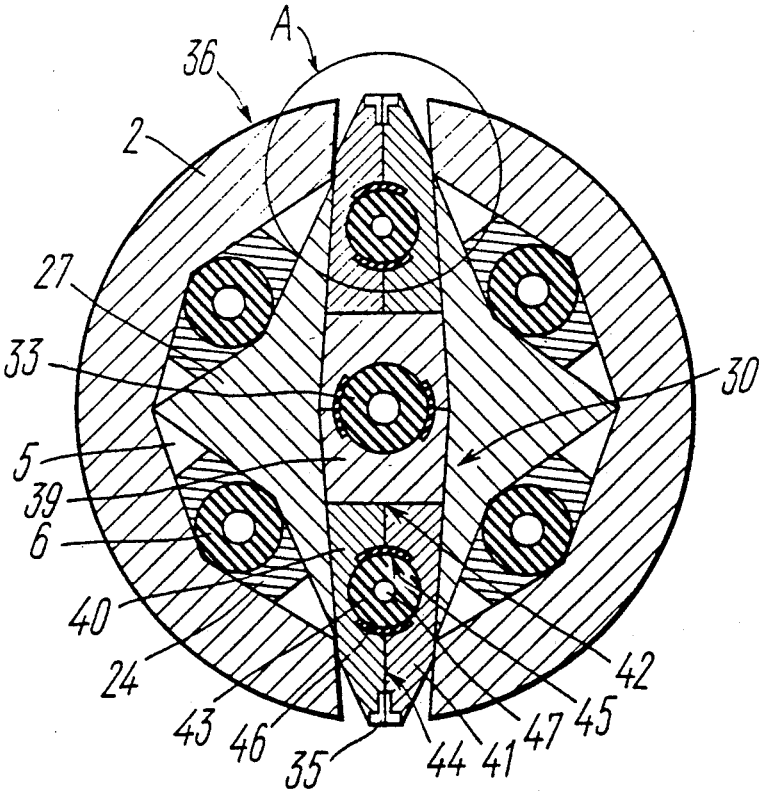
FIG. 5 is a section on line V—V of FIG. 1.

Referring to FIG. 5, each additional wedge-shaped insert comprises three parts 39, 40, 41 which match each other along a line 42 extending parallel to the large base 32' (FIG. 3) of the trapezoid. An other additional expansion chamber 43 in a resilient material is provided between the parts 40 and 41 of each additional wedge-shaped insert 30 so that the outside surface of the chamber 43 contacts the surfaces of the parts 40 and 41 which face each other (this arrangement of the parts 40 and 41 is not shown). The parts 40 and 41 (FIG. 5) of each additional wedge-shaped insert 30 which form the small base 34' (FIG. 3) of the trapezoid can match each other along a line 44 (FIG. 5) extending at right angle to the large base 32' (FIG. 3) of the trapezoid.

When the parts 40, 41 are arranged to match each other at the surfaces facing each other along the line 44, recesses 45 are provided in these surfaces which form a space confined whereto is a further additional expansion chamber 43. This arrangement provides for a more extended contact between the parts 40, 41 and the other additional expansion chamber 43.

Each additional wedge-shaped insert 30 is provided with sealing means between the other additional expansion chamber 43 and the parts 40, 41 within the matching surfaces thereof.

Figure 6:
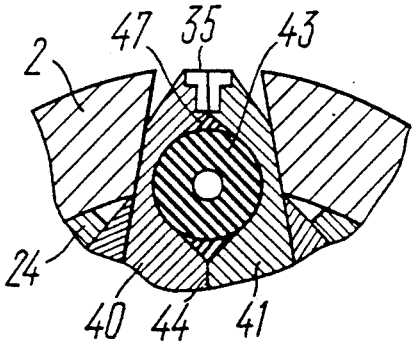
FIG. 6 is a development of the sealing means of the additional wedge-shaped inserts in the form of triangles.

The additional sealing means are provided in this case in the form of gaskets 46 made, e.g., of rubber and given a segmental cross section or of gaskets 47 (FIG. 6) also in rubber but with a triangular cross section. The recesses 45 should be shaped in cross section so that the gaskets 46 (FIG. 5) or the gaskets 47 (FIG. 6) fit therein.

Figure 7:
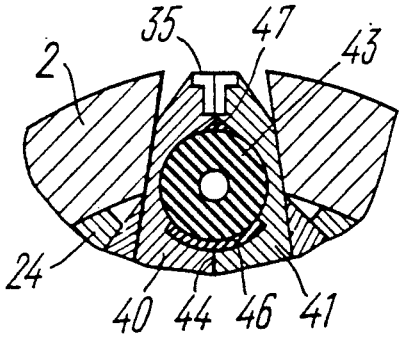
FIG. 7 is another development of the sealing means of the additional wedge-shaped inserts with segmental and triangular cross sections.

In a development of the invention shown in FIG. 7, the gasket 46 provided at the side of the additional expansion chamber 43 facing the line 44 is of the segmental cross section and the gasket 47 provided at the opposite side of the expansion chamber 43 is of the triangular cross section.

Figure 8:
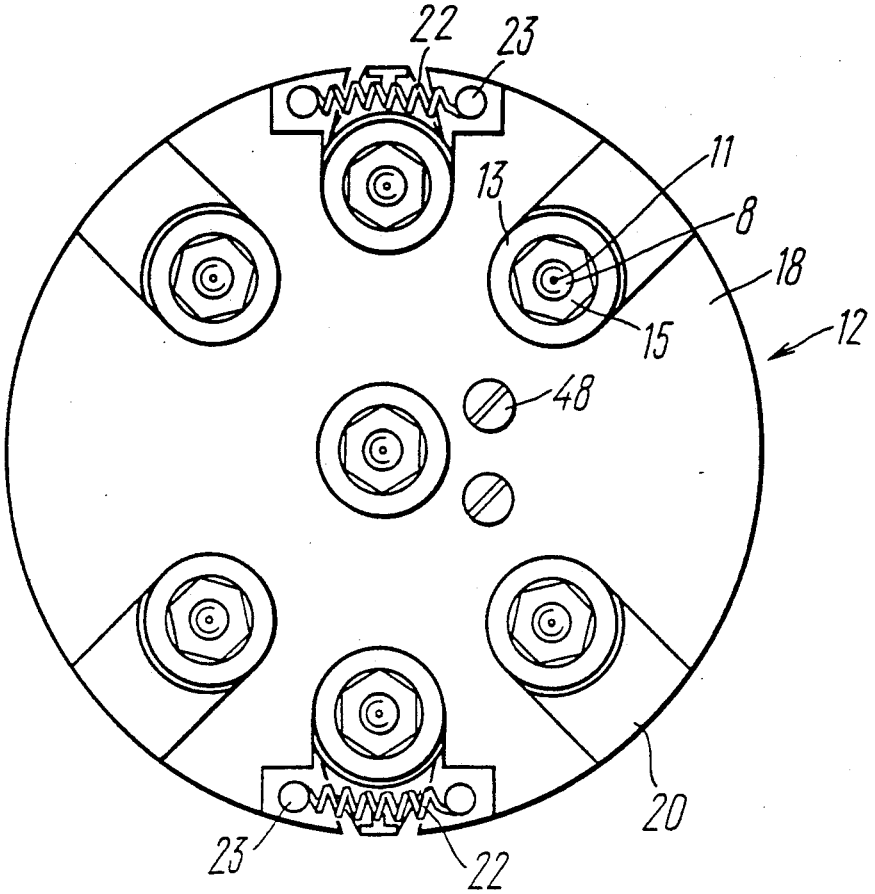
FIG. 8 is a view along arrow A of FIG. 1.

Referring to FIG. 8 which is a view along arrow A of FIG. 1, screws 48 are seen on the right side of the longitudinal axis 3 of the body 1 which hold fast one of the components 27 (FIGS. 2, 3) of the partitioning means 4 to the guide plates 18 (FIG. 1) of the flanges 11, 12 so that the components 27 can be moved apart in operation.

It can be seen in FIG. 8 that the pipe unions 8 fitted to the ends of the expansion chambers 6, 33 and 43 are secured in the flanges 11, 12 with the aid of the sleeves 13, the rings 14 and the nuts 15.

It can also be seen in FIG. 8 that the thrust plates 2 are firmly held together by springs 22 located pairwise at the end faces of the apparatus in a symmetrical way.

The apparatus for disintegrating monolythic entities which is realized in accordance with the present invention and shown in FIGS. 1 through 8 operates as follows.

Preparatory to placing the disclosed apparatus in a hole (not shown) drilled in a monolythic entity, e.g., in a reinforced concrete structure, a mains hose (not shown) is coupled to each pipe union 8 (FIG. 1) located at a side of the apparatus through which the spaces of the expansion chambers 6, 33 and 43 are connected to a source of compressed fluid (not shown). On opening the passage 10 of each pipe union 8 by opening the respective valve, compressed fluid enters into the spaces of the expansion chambers 6, 33, 43, expelling therefrom air over the valves of the pipe unions 8.

When fluid starts issuing from the pipe unions 8 located at the opposite ends of the resilient expansion chambers 6, 33 and 43, indicating that the chambers are filled with the fluid, the source of compressed fluid is disconnected and the passages 10 of the pipe unions 8 are closed by the respective valves.

The disclosed apparatus is then placed into the hole, and the spaces of the resilient expansion chambers 6 and 43 are shut off.

When the source of compressed fluid is connected again, fluid is fed into the space of the additional expansion chamber 33 which swells and exerts pressure on the additional wedge-shaped inserts 30. Moving apart, these bite with their reinforcing elements 35 into the wall of the hole and trigger a crack. Moving further apart, the wedge-shaped inserts 30 act on the thrust plates 2 so that these displace in the direction indicated by arrow a, widening the crack and stretching the reinforcement. This completes an early stage of disintegrating the monolythic entity.

The next stage begins with opening the valves of the pipe unions 8 of the expansion chambers 6. The pressure in the additional expansion chamber 33 remains unchanged.

As compressed fluid is admitted into the expansion chambers 6, these start swelling and exert pressure on the thrust plates 2 and the wedge-shaped inserts 24 with the result that the thrust plates 2 continue their travel in the direction of arrow a. Acted upon by the chambers 6 directly and sustaining the pressure of the chambers 6 through the intermediary of the wedge-shaped inserts 24, the thrust plates widen the crack and stretch the reinforcement still further to the point of rupture. This completes the next stage of the disintegrating operation.

In dealing with huge structures and dense reinforcement, the spaces of the additional expansion chambers 43 are set open while retaining unchanged the pressure of the fluid in the resilient expansion chambers 6 and 33. This signifies the beginning of a concluding stage of disintegration. As fluid is being admitted into the additional expansion chambers 43, these exert pressure on the parts 40 and 41 of the additional wedge-shaped inserts 30 which, in their turn, cause the thrust plates 2 to move still further apart so as to widen the crack and rupture the reinforcement.

On relieving the apparatus of the pressure, the springs 22 return the thrust plates 2 into their original position.

The apparatus is inserted into a next hole, and the cycle is repeated.

A pilot model of the disclosed apparatus, designed for operating from holes with a 105-mm diameter, has a diameter of 100 mm and a length of 1 m. Operating under a fluid pressure of 150 MPa, it develops a total thrust of 6,000 t which breaks down as follows: 4,000 t are attributed to the four resilient expansion chambers 6; 1,000 t, to the additional expansion chamber 33; and 1,000 t, to the other additional expansion chambers 43. This performance makes the disclosed apparatus suitable for disintegrating monolythic reinforced concrete structures.

INDUSTRIAL APPLICABILITY

The disclosed apparatus for disintegrating monolythic entities may be of utility in demolishing foundations and other solid reinforced concrete substructures, severing large natural stone blocks from a series of holes and separating it into smaller blocks, caving strong roof in working blanket deposits, degassing coal seams and probing into the stress-strain behaviour of massive rock formations revealed due to disintegration.

We claim:

1. An apparatus for disintegrating monolythic entities comprising a body having a longitudinal axis;

at least two thrust plates defining said body and capable of reciprocating in a direction perpendicular to said longitudinal axis of said body, said thrust plates having an inner surface;

a partitioning means comprised of at least two similar parts to provide spaces within said body extending parallel to said longitudinal axis of the body;

said similar parts symmetrically positioned with respect to said longitudinal axis of the body and adapted to reciprocate in a direction perpendicular to said longitudinal axis of the body;

said similar parts comprising a surface facing toward said longitudinal axis of the body and defined by two intersecting planes parallel to said longitudinal axis of the body;

first wedge-shaped inserts accommodated in each of said spaces and in contact with said similar parts and the inner surface of said thrust plates;

first expansion chambers accommodated in said spaces between said first wedge-shaped inserts to exert force on said thrust plates and said first wedge-shaped inserts;

fastening means adapted to secure said thrust plates to said body;

second wedge-shaped inserts positioned between said similar parts and adapted to move on said surfaces facing toward said longitudinal axis of the body and exert a force on said similar parts and thrust plates;

a second expansion chamber accommodated coaxially with said longitudinal axis of the body between said second wedge-shaped inserts and being in contact therewith for exerting a force on the second wedge-shaped inserts acting on said similar parts and thrust plates; and a source of working fluid communicating with said first and second expansion chambers to feed the working fluid thereto and thereby produce pressure in said first and second expansion chambers for the resulting force to be transmitted to said first and second wedge-shaped inserts, said similar parts and thrust plates.

2. An apparatus as defined in claim 1 wherein the second wedge-shaped inserts comprise an outside facing surface;

said apparatus further comprising reinforcing elements secured on said outside facing surfaces of the second wedge-shaped inserts.

3. An apparatus as defined in claim 2 wherein said second wedge-shaped inserts have a surface facing toward said longitudinal axis of the body and match each other at portions of said surfaces;

said apparatus further comprising recesses at said surface of said second wedge-shaped inserts facing toward said longitudinal axis of the body;

a space defined between the surfaces of said recesses facing each other to accommodate said second expansion chamber; and sealing elements positioned between said second expansion chamber and said second wedge-shaped inserts in proximity to said matching surfaces.

4. An apparatus as defined in claim 2 wherein said second wedge-shaped inserts have a trapezoidal cross-section and comprise three parts, one of said parts positioned at the side of a major base of said trapezoid, said three parts of the second wedge-shaped insert matching with each other along a line parallel with said major base of the trapezoid, two of said three parts of the second wedge-shaped insert positioned at the side of a minor base of said trapezoid;

said apparatus further comprising a third expansion chamber positioned between said two parts of each said second wedge-shaped inserts.

5. An apparatus as defined in claim 4 wherein two of said three parts of each second wedge-shaped insert located at the side of the minor base of said trapezoid match each other along a line perpendicular to the major base of said trapezoid, and comprise recesses at said matching surfaces of said two parts, said recesses having surfaces facing each other and defining a space, wherein said third expansion chamber is positioned in said space of each second wedge-shaped insert.

6. An apparatus as defined in claim 5 wherein each of said second wedge-shaped inserts has sealing elements, said sealing elements positioned between said third expansion chamber and said two of said three parts of the second wedge-shaped insert at the matching locations.

7. An apparatus as defined in claim 6 wherein said sealing elements are in the form of gaskets having a cross-section in the form of an annular segment.

8. An apparatus as defined in claim 6 wherein said sealing elements of the second wedge-shaped inserts are in the form of gaskets having a triangular cross-section.

9. An apparatus as defined in claim 1 wherein the second wedge-shaped inserts have a surface facing toward said longitudinal axis of the body and match each other at portions of said surfaces;

said apparatus further comprising recesses at said surface of said second wedge-shaped inserts facing toward said longitudinal axis of the body;

a space defined between the surfaces of said recesses facing each other to accommodate said second expansion chamber; and sealing elements positioned between said second expansion chamber and said second wedge-shaped inserts in proximity to said matching surfaces.

10. An apparatus as defined in claim 9 or 4 wherein said sealing elements positioned between said second expansion chamber and said second wedge-shaped inserts in proximity to said matching portions are in the form of gaskets having a cross-section in the form of an annular segment.

* * * * *